US007458562B1

(12) United States Patent
Chen et al.

(10) Patent No.: US 7,458,562 B1
(45) Date of Patent: Dec. 2, 2008

(54) EXTENDIBLE AND RETRACTABLE ACTUATOR

(75) Inventors: Tung-Hsin Chen, Taichung (TW); Bing-Hong Yang, Taichung (TW)

(73) Assignee: Hiwin Mikrosystem Corp., Taichung (TW)

( * ) Notice: Subject to any disclaimer, the term of this patent is extended or adjusted under 35 U.S.C. 154(b) by 25 days.

(21) Appl. No.: 11/769,710

(22) Filed: Jun. 28, 2007

(51) Int. Cl.
*B66F 3/18* (2006.01)

(52) U.S. Cl. ..... 254/103; 254/7 B; 254/2 B; 254/97; 254/98

(58) Field of Classification Search ..... 254/103, 254/2 B, 8 B, 102, 98, 92, 7 B
See application file for complete search history.

(56) References Cited

U.S. PATENT DOCUMENTS 34,063 A * 1/1862 Landis ..... 254/92
3,514,090 A * 5/1970 Wuesthoff ..... 269/60
4,387,881 A * 6/1983 McDuffie ..... 254/89 H
4,396,047 A * 8/1983 Balkus ..... 144/193.1
6,145,812 A * 11/2000 Ivanova ..... 254/103
6,581,910 B1 * 6/2003 Granata ..... 254/95
2003/0001144 A1 * 1/2003 Kubota ..... 254/103
2008/0149904 A1 * 6/2008 Garceau ..... 254/103

* cited by examiner

*Primary Examiner*—Lee D Wilson
(74) *Attorney, Agent, or Firm*—Banger Shia

(57) ABSTRACT

An extendible and retractable actuator comprises a motor, two screws and an extendible and retractable sleeve assembly. The motor cooperates with the screws to drive the extendible and retractable sleeve assembly to extend and retract simultaneously, so as to reduce the extending and retracting time and to simplify the structure of the extendible and retractable actuator.

4 Claims, 9 Drawing Sheets

EXTENDIBLE AND RETRACTABLE ACTUATOR

BACKGROUND OF THE INVENTION

1. Field of the Invention

The present invention relates to a motion transmission device, and more particularly to an extendible and retractable actuator.

2. Description of the Prior Art

The use of actuators are quite extensive, a motor of one kind of the actuators is mounted in an extendible and retractable sleeve and drives the sleeve to extend and retract, and then the extending and retracting motion of the sleeve drives other mechanisms to move.

Referring to FIG. 1, a conventional extendible and retractable actuator comprises a base A, an extendible and retractable sleeve assembly 10, a motor 20, a first screw 30, a second screw 40 and a third screw 50. The sleeve assembly 10 includes an outer sleeve 11, a middle sleeve 12 and an inner sleeve 13. One end of the outer sleeve 11 is fixed to the base A, and the motor 20 is fixed in the inner sleeve 13 of the sleeve assembly 10. The first screw 30 is a hollow member defined with outer threads on an outer surface thereof one end of the first screw 30 is connected to the motor 20 and is rotated by the motor 20, and the extending direction of the first screw 30 corresponds to the moving direction of the sleeve assembly 10. The second screw 40 is rotatably mounted in the middle sleeve 12 of the sleeve assembly 10, and the second screw 40 is a hollow member defined with inner threads to be engaged with the outer threads of the first screw 30. The third screw 50 is fixed to the base A and is defined with outer threads to be engaged with the inner threads of the second screw 40, and the third screw 50 is inserted into the first screw 30.

With reference to FIG. 2, during the operation of the extendible and retractable actuator, the motor 20 rotates the first screw 30 and drives it to move along the inner threads of the second screw 40, so as to drive the inner sleeve 13 to extend outward.

When the first screw 30 rotates to the maximum length position relative to the second screw 40 as shown in FIG. 3, the first screw 30 will be driven by the motor 20 to rotate the second screw 40, and the second screw 40 will move along the outer threads of the third screw 50 and drive the middle sleeve 12 to extend outward.

However, the above-mentioned conventional extendible and retractable actuator has the following disadvantages:

Firstly, the extending and retracting motion of the extendible and retractable actuator takes a lot of time, since the middle sleeve 12 can be driven to extend only when the inner sleeve 13 extends to the end of maximum travel length.

Secondly, the components of the conventional extendible and retractable actuator are likely to be damaged, since the second screw 40 can be driven to rotate only when the first screw 30 rotates to the end of maximum travel length.

Thirdly, the conventional extendible and retractable actuator is difficult to process, since the first screw 30 must be hollow and defined with outer threads, and the second screw 40 must be defined with inner threads to be engaged with the outer threads of the first and the third screws 30 and 50.

Therefore, another conventional extendible and retractable actuator appears on the market, as shown in FIG. 4, which comprises a base A, an extendible and retractable sleeve assembly 10, a motor 20, a first screw 30, a second screw 40 and a wheel 60. The sleeve assembly 10 includes an outer sleeve 11, a middle sleeve 12 and an inner sleeve 13. One end of the outer sleeve 11 is fixed to the base A, and the motor 20 is fixed to the base A. The first screw 30 is defined with outer threads, one end of the first screw 30 is connected to the motor 20 and is rotated by the motor 20, and the extending direction of the first screw 30 corresponds to the moving direction of the sleeve assembly 10. The second screw 40 is connected to the middle sleeve 12 and is inserted into the inner sleeve 13, and one end of the second screw 40 is open and is defined with inner threads to be engaged with the outer threads of the first screw 30. The wheel 60 is fixed to the other end of the second screw 40 and a rope 61 wind around it, one end of the rope 61 is fixed in the inner sleeve 13, and the other end of the rope 61 is fixed to the base A after passing through the inner sleeve 13 and the middle sleeve 12.

With reference to FIG. 5, during the operation of the extendible and retractable actuator, the motor 20 rotates the first screw 30 and drives it to move along the inner threads of the second screw 40, so as to drive the second screw 40 to move, and the second screw 40 drives the middle sleeve 12 to extend outward. At that time, the wheel 60 moves along the second screw 40 and drives the inner sleeve 13 to move, since one end of the rope 61 is fixed to the base A. Moreover, according to the principle of the movable pulley, the displacement of the inner sleeve 13 with respect to the outer sleeve 11 is double that of the displacement of the middle sleeve 12 relative to the outer sleeve 11. By such arrangements, the middle sleeve 12 and the inner sleeve 13 can be moved simultaneously, so as to reduce the extending and retracting time of the extendible and retractable actuator.

However, the above-mentioned conventional extendible and retractable actuator still has the following disadvantages:

Firstly, the above-mentioned conventional extendible and retractable actuator is hard to assemble, since the components are engaged with each other, and the middle sleeve 12 and the inner sleeve 13 can be moved simultaneously only when the rope 61 winds around the wheel 60.

Secondly, the components of the conventional extendible and retractable actuator are likely to be damaged, since the middle sleeve 12 and the inner sleeve 13 can be moved simultaneously only when the rope 61 winds around the wheel 60, the force applied on the rope 61 is quiet big, and the rope 61 will be broke if the force is too big. In addition, the rope 61 can be replaced by chain, however, the chain can also cause abrasion to the wheel 60.

The present invention has arisen to mitigate and/or obviate the afore-described disadvantages.

SUMMARY OF THE INVENTION

The primary objective of the present invention is to provide an extendible and retractable actuator, both ends of the extendible and retractable sleeve assembly can be extended and retracted simultaneously by a shaft protruded out of both ends of the motor, so as to reduce the extending and retracting time, simplify the structure and reduce the cost.

To achieve the object of the present invention, the extendible and retractable actuator of the present invention comprises an extendible and retractable sleeve assembly, a motor, a first screw, a gear box and a second screw. The motor mounted in one sleeve of the extendible and retractable sleeve assembly, and the shaft of the motor protrudes out of both ends of the motor. The first screw is connected to one end of the shaft of the motor, the extending direction of the first screw corresponds to the moving direction of the extendible and retractable sleeve assembly, and the first screw is engaged with one end of the extendible and retractable sleeve assembly. The gear box and the motor are disposed in the same sleeve, the gear box is connected to the other end of the shaft of the motor and the second screw, respectively, and the second screw is fixed to the other end of the extendible and retractable sleeve assembly.

During the extending and retracting motion of the extendible and retractable actuator, the motor rotates the first screw and the gear box, and the first screw drives the sleeve at one end of the extendible and retractable sleeve assembly to extend and retract. And the gear box cooperates with the second screw to drive the sleeve at the other end of the extendible and retractable sleeve assembly, enabling the sleeves at both ends of the extendible and retractable sleeve assembly to extend and retract simultaneously. Therefore, the extendible and retractable actuator of the present invention has the following advantages:

Firstly, the structure of the present invention is simple, since the motor, the screw and the gear are easy to process and can cooperate with each other to make both ends of the extendible and retractable sleeve assembly extend and retract simultaneously.

Secondly, the present invention is less likely to be damaged, since the screw and the gear have high structure strength and simplified structure.

Thirdly, the cost of the present invention is low, since the components are easy to process and unlikely to be damaged.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
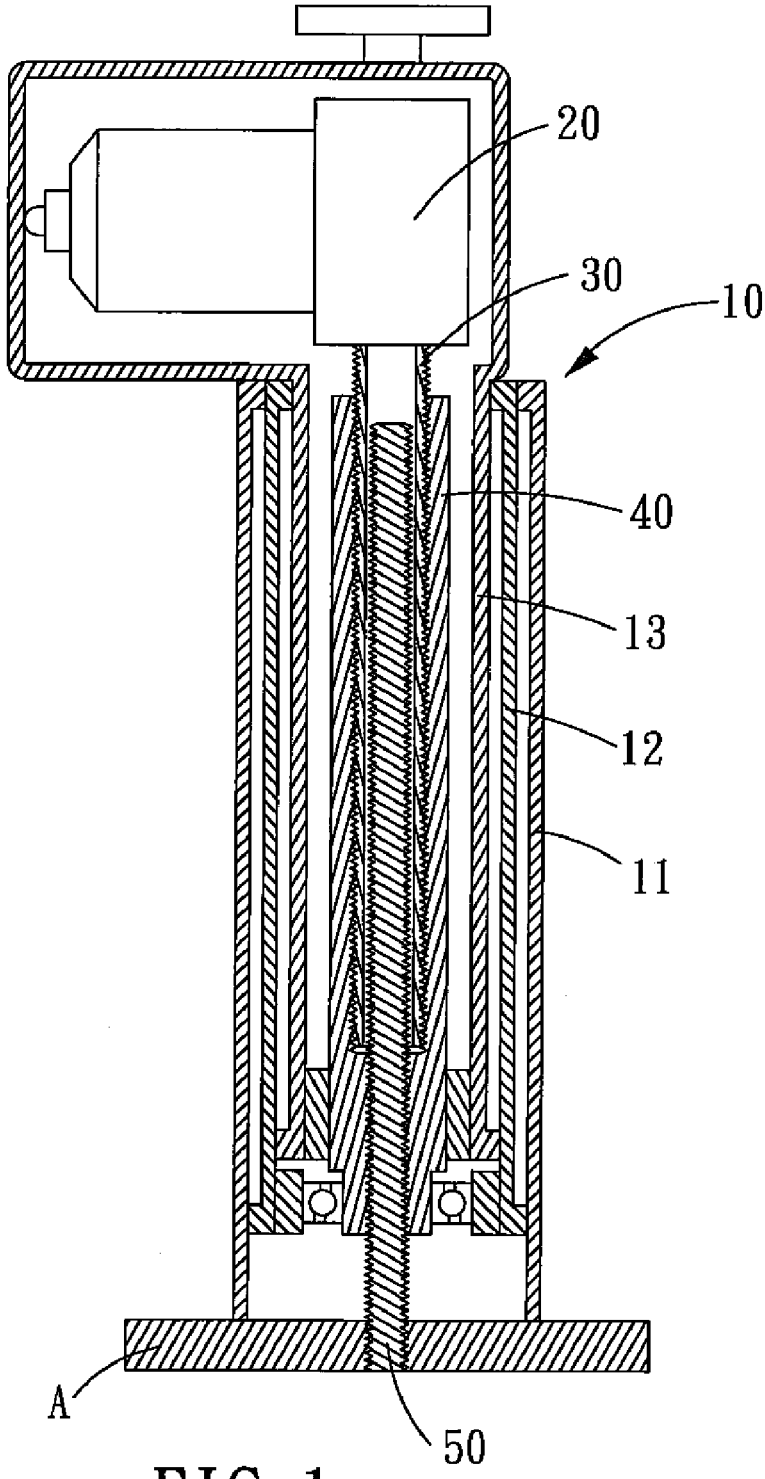
FIG. 1 PRIOR ART
FIG. 1 is an illustrative view of showing a conventional extendible and retractable actuator.
Figure 2:
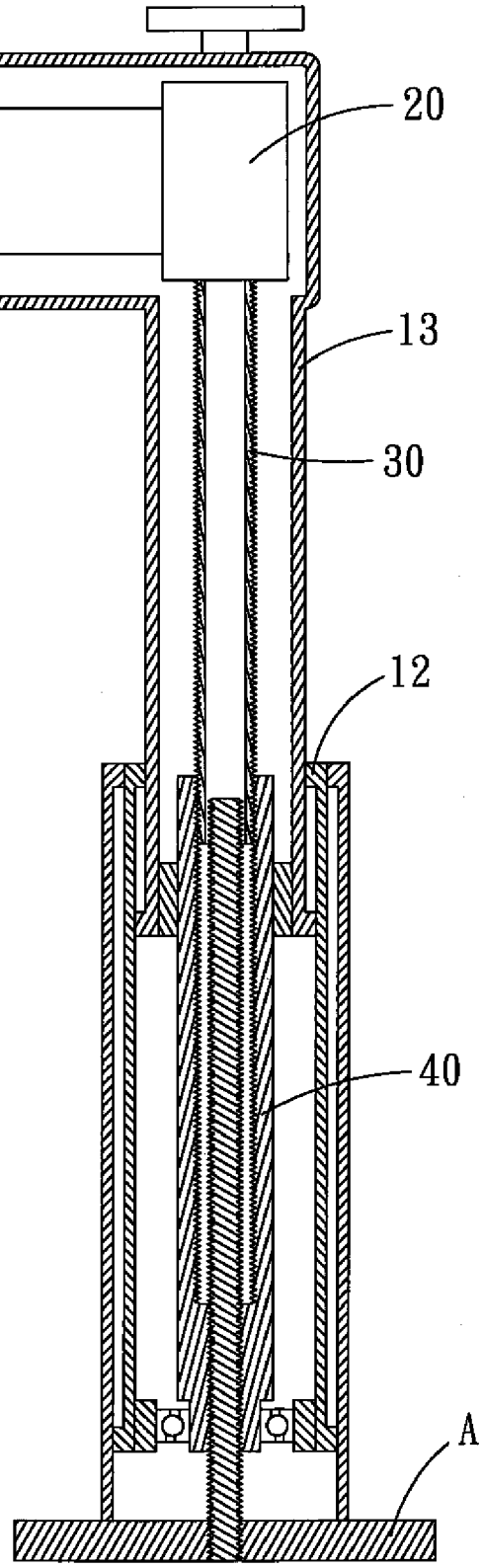
FIG. 2 PRIOR ART
FIG. 2 is an illustrative view of showing the extending motion of an inner sleeve of FIG. 1.
Figure 3:
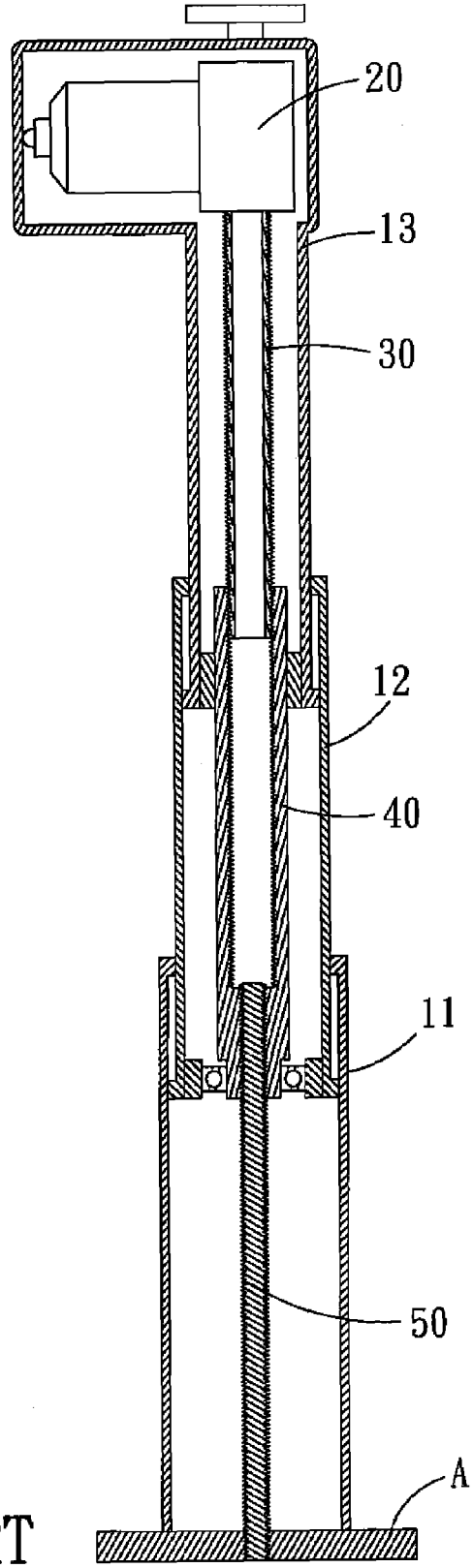
FIG. 3 PRIOR ART
FIG. 3 is an illustrative view of showing the extending motion of a middle sleeve of FIG. 2.
Figure 4:
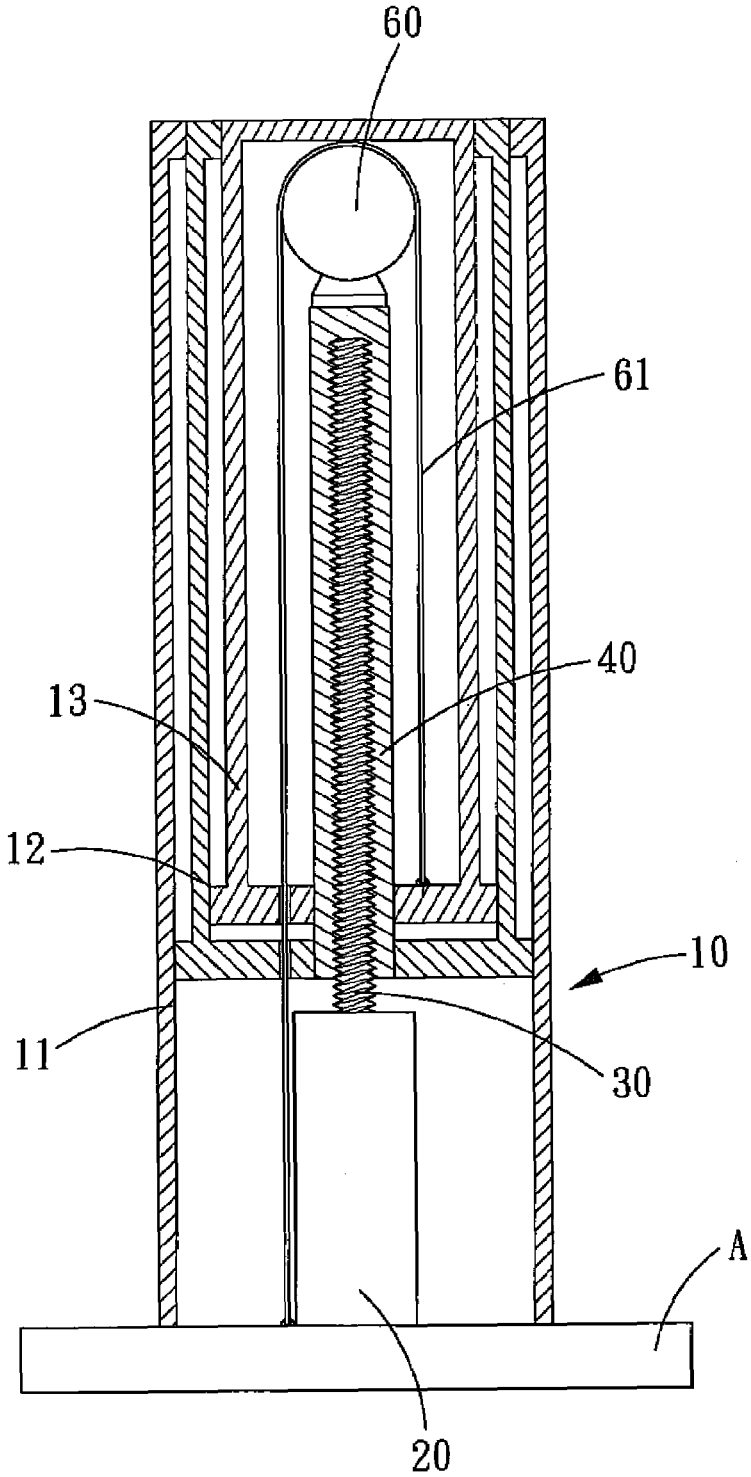
FIG. 4 PRIOR ART
FIG. 4 is an illustrative view of showing another conventional extendible and retractable actuator.
Figure 5:
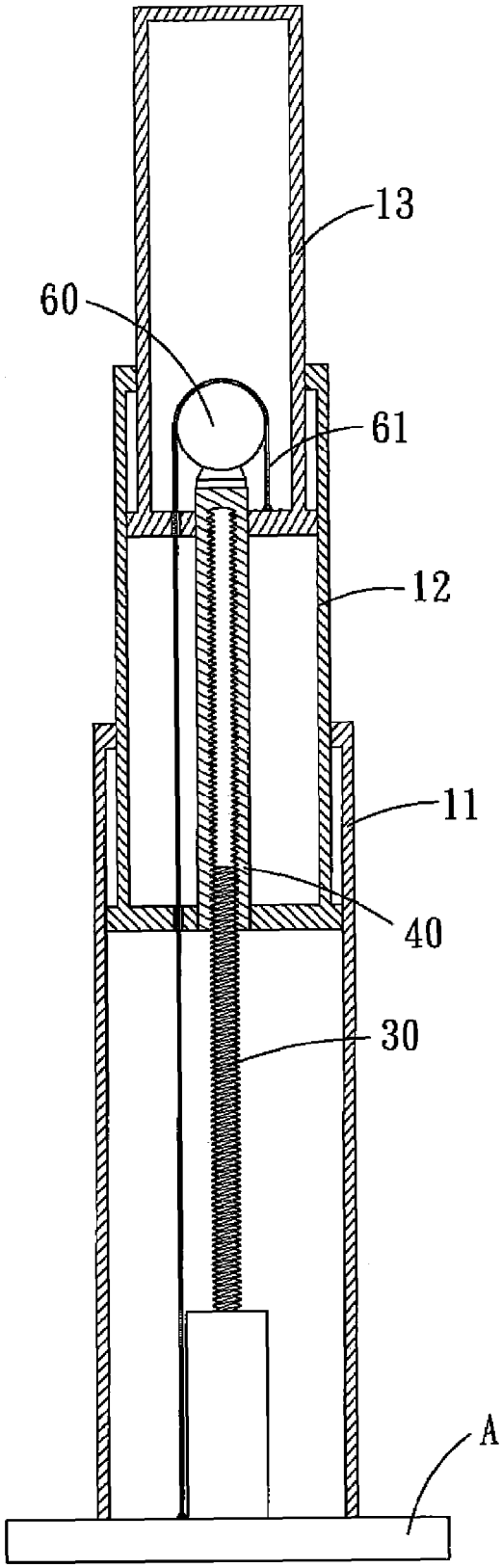
FIG. 5 PRIOR ART
FIG. 5 is an illustrative view of showing that the inner sleeve and the middle sleeve of FIG. 4 extend simultaneously.
Figure 6:
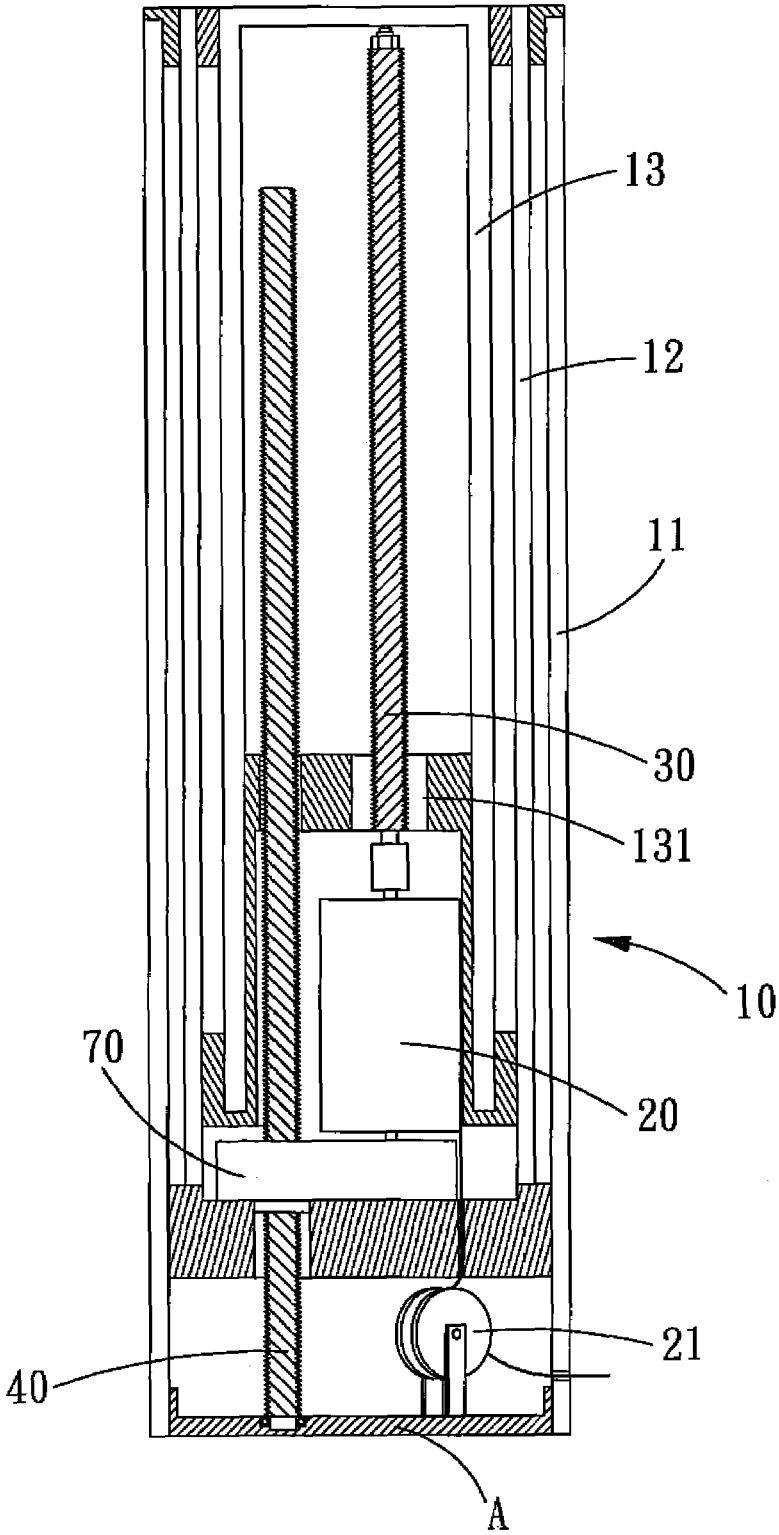
FIG. 6 is an illustrative view of an extendible and retractable actuator in accordance with the present invention.

Referring to FIG. 6, an extendible and retractable actuator in accordance with the present invention comprises: a base A, an extendible and retractable sleeve assembly 10, a motor 20, a first screw 30, a second screw 40 and a gear box 70.

The extendible and retractable sleeve assembly 10 includes an outer sleeve 11, a middle sleeve 12 and an inner sleeve 13. One end of the outer sleeve 11 is fixed to the base A, and a screw 131 is fixed in the inner sleeve 13.

The motor 20 is mounted in the middle sleeve 12 of the extendible and retractable sleeve assembly 10, and the shaft of the motor 20 protrudes out of both ends of the middle sleeve 12. A roller 21 with elastic restoration force is fixed to the base A. The power wire of the motor 20 winds around the roller 21 and is connected to the power source after passing through the outer sleeve 11.

One end of the screw 30 is connected to one end of the shaft of the motor 20, the first screw 30 extends toward the interior of the inner sleeve 13, and the extending direction of the first screw 30 corresponds to the moving direction of the extendible and retractable sleeve assembly 10. In addition, the first screw 30 is engaged with the nut 131 of the inner sleeve 13.

The second screw 40 is received in the middle sleeve 12 and the inner sleeve 13 of the extendible and retractable sleeve assembly 10, and one end of the second screw 40 is fixed to the base A.

Figure 7:
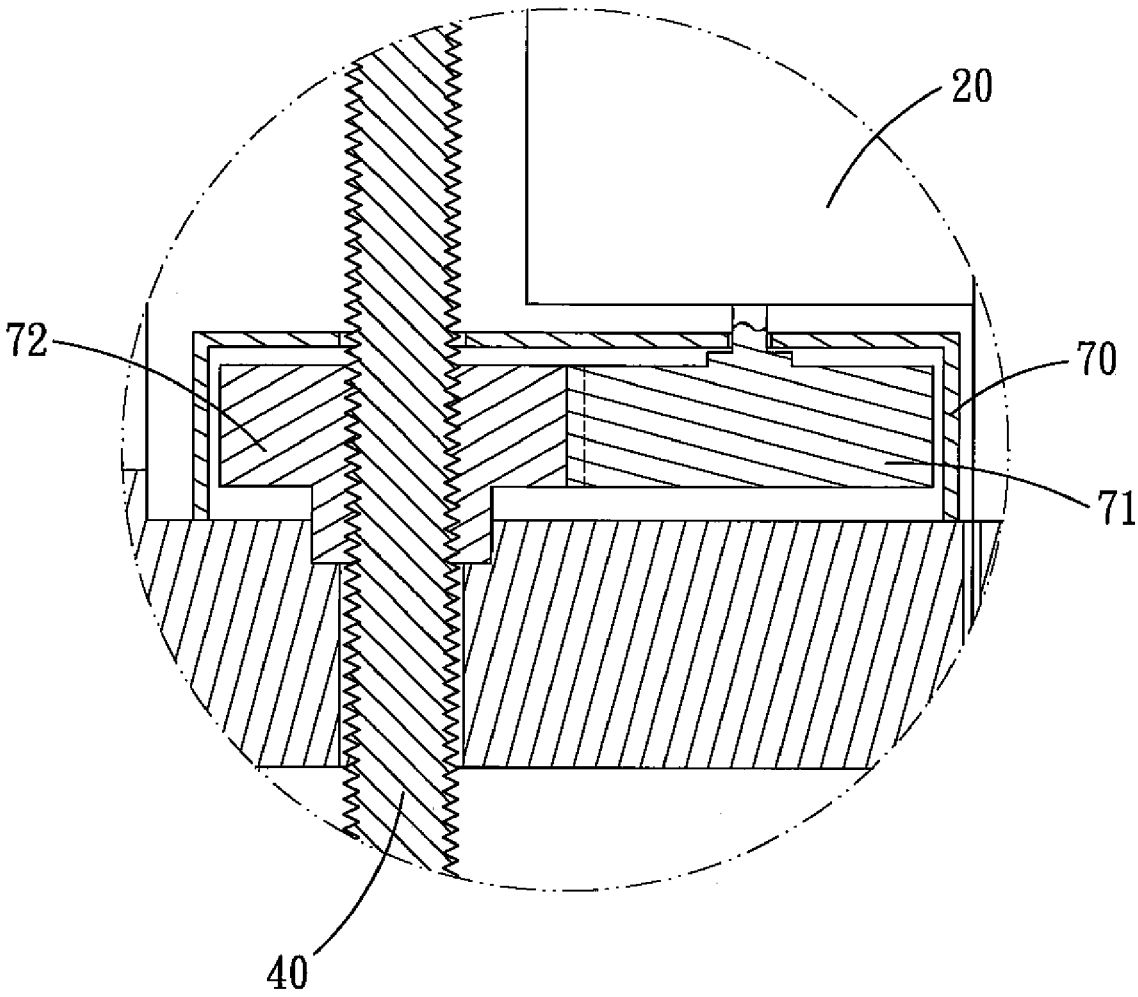
FIG. 7 is an illustrative view of showing a driving gear engaged with a driven gear of the extendible and retractable actuator in accordance with the present invention.
Figure 8:
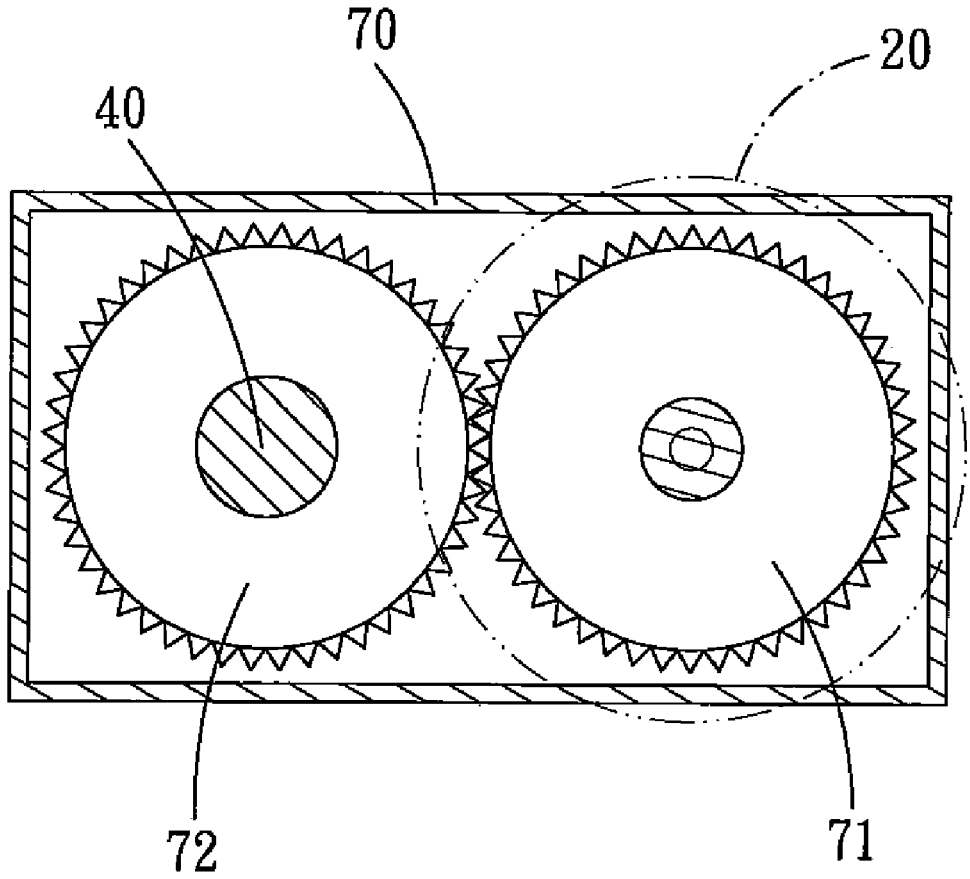
FIG. 8 is another illustrative view of FIG. 7.

The gear box 70 is disposed in the middle sleeve 12, as shown in FIGS. 7 and 8, and comprises a driving gear 71 and a driven gear 72 engaged with each other. The driving gear 71 is connected to the other end of the shaft of the motor 20. The driven gear 72 is defined with inner threads to be engaged with the second screw 40, and the number of the teeth of the driving gear 71 is the same as that of the driven gear 72.

Figure 9:
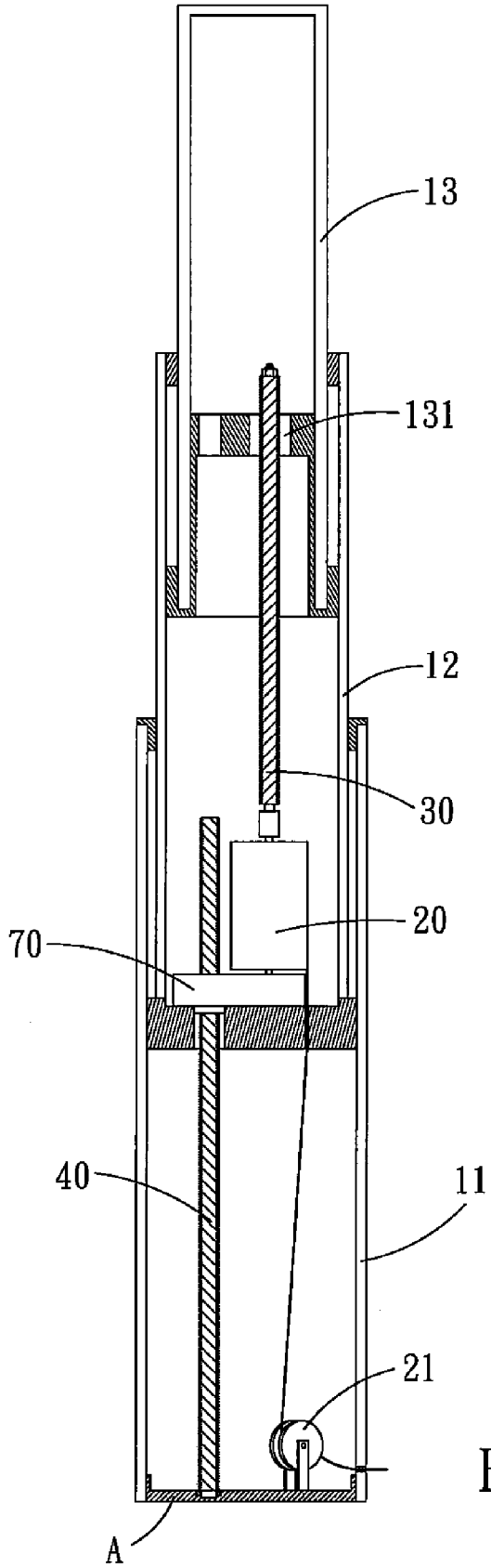
FIG. 9 is an illustrative view of showing the simultaneous extending and retracting motion of the extendible and retractable actuator in accordance with the present invention.

With reference to FIG. 9, during the moving of the extendible and retractable actuator, the motor 20 rotates the first screw 30 and the driving gear 71 of the gear box 70, and the first screw 30 cooperates with the nut 131 of the inner sleeve 13 to cause extension and retraction of the inner sleeve 13. In addition, the driving gear 71 rotates the driven gear 72, and the driven gear 72 cooperates with the second screw 40 to cause extension and retraction of the middle sleeve 12. Since the rotating direction of the first screw 30 is the same as that of the driving gear 71, and the rotating direction of the driving gear 71 is opposite that of the driven gear 72, the rotating direction of the first screw 30 is opposite that of the driven gear 72. Thereby, the sleeves at both ends of the extendible and retractable actuator can be extended and retracted simultaneously.

Further, the rotating speed of the first screw 30 is the same as that of the driving gear 71, and the number of the teeth of the driving gear 71 is the same as that of the driven gear 72, so the rotating speed of the driving gear 71 is the same as that of the driven gear 72. Thereby, the rotating speed of the first screw 30 and that of the driven gear 72 with respect to the second screw are the same, enabling the sleeves at both ends of the extendible and retractable actuator to extend and retract at the same speed.

In addition, the motor 20 moves along with the extension of the middle sleeve 12 and pulls the power wire to make the roller 21 store elastic force. During the retraction of the middle sleeve 12, the power wire of the motor 20 will be pulled straightly by the elastic restoration force of the roller 21.

To summarize, the extendible and retractable actuator of the present invention uses the motor to make the sleeves of the extendible and retractable sleeve assembly 10 extend and retract simultaneously at the same speed, the components of the present invention are simple and have high structure strength. Therefore, the present invention is low cost, simple in structure and is unlikely to be damaged.

While we have shown and described various embodiments in accordance with the present invention, it should be clear to those skilled in the art that further embodiments may be made without departing from the scope of the present invention.

What is claimed is:

1. An extendible and retractable actuator, comprising:

an extendible and retractable sleeve assembly;

a motor mounted in one sleeve of the extendible and retractable sleeve assembly, a shaft of the motor protruded out of both ends of the motor;

a first screw connected to one end of the shaft of the motor, the extending direction of the first screw corresponds to the moving direction of the extendible and retractable sleeve assembly, the first screw being engaged with one end of the extendible and retractable sleeve assembly and rotated by the motor to drive one end of the extendible and retractable sleeve assembly to extend and retract;

a gear box connected to the other end of the shaft of the motor; and a second screw fixed to the other end of the extendible and retractable sleeve assembly and engaged with the gear box, the gear box being driven by the motor to move relative to the second screw, so as to drive the other end of the extendible and retractable sleeve assembly to extend and retract.

2. The extendible and retractable actuator as claimed in claim 1, wherein the gear box includes a driving gear and a driven gear engaged with each other, the driving gear is fixed to the other end of the shaft of the motor, and the driven gear is defined with inner threads to be engaged with the second screw.

3. The extendible and retractable actuator as claimed in claim 2, wherein a number of the teeth of the driving gear is the same as that of the driven gear.

4. The extendible and retractable actuator as claimed in claim 1, wherein a roller with elastic restoration force is fixed to one end of the extendible and retractable sleeve assembly, a power wire of the motor winds around the roller and passes through the extendible and retractable sleeve assembly.

* * * * *